US005240822A

United States Patent [19]

Tanaka et al.

[11] Patent Number: 5,240,822

[45] Date of Patent: Aug. 31, 1993

[54] PACKED PHOTOGRAPHIC SOLID PROCESSING AGENTS

[75] Inventors: Kenichi Tanaka, Hachioji; Takeo Arai, Hino, both of Japan

[73] Assignee: Konica Corporation, Tokyo, Japan

[21] Appl. No.: 736,595

[22] Filed: Jul. 26, 1991

[30] Foreign Application Priority Data

Jul. 30, 1990 [JP] Japan ..... 2-203165
Jul. 30, 1990 [JP] Japan ..... 2-203167

[51] Int. Cl.[5] ..... G03C 5/30; G03C 5/38

[52] U.S. Cl. ..... 430/450; 430/458; 430/465

[58] Field of Search ..... 430/450, 458, 465

[56] References Cited

U.S. PATENT DOCUMENTS 4,518,520 5/1985 Eoga ..... 252/DIG. 16
5,135,840 8/1992 Reuter et al. ..... 430/465

*Primary Examiner*—Hoa Van Le
*Attorney, Agent, or Firm*—Finnegan, Henderson, Farabow, Garrett & Dunner

[57] ABSTRACT

A packed photographic processing agent to be used for an automatic processor, in a plate form with holes solidified by adding a water-soluble polymer, is disclosed. It is lighter than the bottled conc. liquid type agent and more compact than the powder type agent packed in an envelope.

A packed material made of disposable cardboard is teared off when it is pushed into a charging opening of an automatic solution preparing unit equipped to the automatic processor.

10 Claims, 3 Drawing Sheets

PACKED PHOTOGRAPHIC SOLID PROCESSING AGENTS

FIELD OF THE INVENTION

The present invention relates to a method of solidifying photographic processing agents used in development of photographic light-sensitive materials. More specifically, this invention relates to a method of molding photographic solid processing agents which are less in aging deterioration such as oxidation as well as more advantageous in transport and supply due to their lightness when compared with conventional liquid processing agents, and which are less in scattering and more adaptable for automatic feeding unit as compared with conventional powder processing agents; and relates to packed photographic solid processing agents, and more specifically to packed photographic solid processing agents which are adaptable for processing photographic light-sensitive materials with automatic developing machines, excellent in storage stability and improved in water-solubility so as to be readily made into a solution.

BACKGROUND OF THE INVENTION

Automatic developing machines, which develop, fix and bleach photographic light-sensitive materials, require that their respective processing baths be supplied with fixed amounts of processing agents in the form of replenishing solutions, because of the loss resulting from taking out by processed light-sensitive materials as well as evaporation, oxidation or degradation.

These replenishing processing agents are generally supplied in the form of solid or highly concentrated solution, and dissolved or diluted before use.

The present inventors disclosed, in Japanese Patent O.P.I. Publication No. 135887/1990, an automatic developing machine and related solid processing agents which are supplied as large blocks, dissolved in replenishing solution tanks and pumped into processing tanks.

As stated above, the product form of conventional photographic processing agents falls into two large types; namely, liquid and powder. And automatic developing machines,used for processing large amounts of light-sensitive materials, require that the processing tanks be replenished with respective replenishing solutions to replenish processing solutions consumed in proportion to the processed amount.

In feeding a replenishing solution to a processing bath, while a liquid type processing agent can be simply pumped from replenishing tank to processing tank, a powder type processing agent is directly fed into a processing tank and stirred for a certain time, or dissolved in a warm water beforehand and poured into a processing tank.

The powder type photographic processing agent, which used to be widely utilized, was gradually replaced by the liquid type. The reason lies firstly in the inconvenience that it needs a dissolving procedure, such as heating or stirring of a solution containing the agent, which is not suited for continuous operation of the automatic developing machines; and secondly in the necessity for complicated manufacturing contrivances in order to maintain components of a processing agent at a uniform mixing ratio.

However, the powder type processing agent is still used and improved in many ways at present, since it has a decisive advantage over the liquid type in transport and supply because of its lightness and non-bulkiness.

For example, there is utilized a vacuum-packed solid processing agent, in which a powder processing agent is divided by components formed in layers, then packed in an airtight bag. In this case, a contrivance is made to separate components in the bag which react one another upon contact. But this package allows the processing agent to be crushed to powder upon unpacking; therefore, it is not suited to the automatic solution preparing unit for a replenishing processing solution built in the automatic developing machine, and when handled manually, it shows a disadvantage of scattering fine powder.

SUMMARY OF THE INVENTION

Under the circumstances, the first object of the present invention is to establish a method of manufacturing a photographic solid processing agent which is convinient in transport and supply, less in aging degradation and adoptable for use in automatic developing machines, particularly for replenishment of a processing solution with an automatic solution preparing unit.

Figure 1:
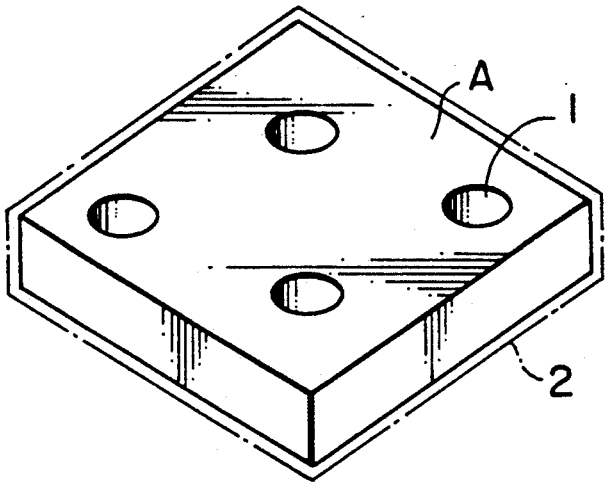
FIGS. 1 to 3 are oblique views illustrating examples of the embodiment of the invention. In the figures, A, B and C are photographic solid processing agents different in forms; 1 and 2 show an opening and a container, respectively.

1: control panel, 2: replenisher tank, 3: automatic processor, 4: mixing tank, 5: washing tank, 6: part A of the fixer, 7: part B of the fixer, 8: developer, 9: fixer, 10: electromagnetic valve box, 11: part A of the developer, 12: part B of the developer.

DETAILED DESCRIPTION OF THE INVENTION

The first object of the invention is attained by any of the measures of {1} one or more of powder or granular chemicals used in a photographic processing agent and a fixed amount of a water-soluble polymer are poured, after mixing or or as they are, into a prescribed mold, and then dried to solid therein after mixing or as it is, {2} one or more of powder or granular chemicals used in a photographic processing agent are placed in a mold containing a fixed amount of a water-soluble polymer and stirred, then the mixture is dried to solid, {3} a fixed amount of a water-soluble polymer is placed in a mold containing one or more of powder or granular chemicals used in a photographic processing agent and stirred, then the mixture is dried to solid, {4} a fixed amount of a water-soluble polymer is added to a photographic processing agent prepared in a powder or granular form and jointly poured into a prescribed mold, and then dried to solid, {5} a photographic processing agent prepared in a powder or granular form is thrown into a mold containing a fixed amount of a water-soluble polymer and stirred, then the mixture is dried to solid and {6} a fixed amount of a water-soluble polymer is thrown in a mold containing a photographic processing agent prepared in a powder or granular form and stirred, then the mixture is dried so solid.

In recent years, however, consumption of powder, granular or molded processing agents is changing to an upward tendency with the advance in the automatic solution preparing unit and manufacturing technology of solid processing agents.

In preparing a processing solution with an automatic solution preparating unit (including that built in an automatic developing machine), the packing material of the processing agent is required to have a certain magnitude of physical strength because of the mechanical structure of the automatic solution preparing unit.

Accordingly, processing agents are packed in plastic boxes or analogous containers, but this arouses the following problems:

First, unlike packing materials for liquid processing agents, packing materials for solid processing agents have a certain strength by themselves; therefore, it is rather difficult to crush waste containers to small pieces, and much labor is required to recover or scrap waste containers as compared with the case of liquid processing agents.

Second, disposal of waste containers requires a fairly large expense, because environmental disruption is caused unless they are disposed in a proper way.

While liquid processing agents are widely used for their high miscibility with water and easiness of manufacture, they have disadvantages in transport since they are too heavy and bulky by the amount of water used dissolving, and further, they occasionally cause accidents such as spilling when charged into a replenishing solution tank of automatic developing machine.

On the other hand, solid processing agents are advantageous in transport; but, they have a drawback of needing a dissolving process as compared with liquid ones, and particularly, those in the form of blocks still have a problem in dissolution in water.

The second object of the invention is to establish a photographic solid processing agent packed with a packing material which has a strength high enough to stand the use in an automatic solution preparating unit and is disposable at a low cost, and to establish a packed photographic solid processing agent having a high solubility in water and easy in procedure of solution preparation.

The second object of the invention is achieved by a packed photographic solid processing agent comprising a powder, granular and/or molded processing agent packed with a container such as a cardboard case, wherein {1} the surface and/or the reverse side of said cardboard case is coated with plastic film in order to exclude the outside air, {1} said photographic processing agent is molded into plates having openings in arbitrary numbers and of arbitrary shapes, {3} said photographic processing agent is solidified utilizing a water-soluble polymer, and {4} the surface of said packed photographic processing agent is coated with the water-soluble polymer. In the above, the cardboard may be that containing reclaimed paper or that made from pulp.

The photographic processing agent according to the invention includes a color developer, monochrome developer, fixer, bleacher, stop solution, stabilizer, and rinse solution, which are primarily used in an automatic developing machine.

The automatic developing machine mentioned here means an automatic developing machine to treat, with processing solutions for development, photographic light-sensitive materials for color negative, color paper and monochrome (for example, light-sensitive materials for medical or industrial X-ray photography, light-sensitive materials for photoengraving, light-sensitive materials for graphic arts, light-sensitive materials for microphotography, micro-reversal photographic light-sensitive materials for X-ray, paper for computer-aided photocomposition, negative photographic light-sensitive materials for general photography, and photographic paper), and latent images (exposure) of said light-sensitive materials as well.

Preferable developers are those solutions which contain the following developing agents.

Examples of the black and white developing agent are dihydroxy benzenes (for example, hydroquinone, chlorohydroquinone, bromohydroquinone, isopropyl hydroquinone, methyl hydroquinone, 2,3-dichlorohydroquinone, 2,5-dimethyl hydroquinone, potassium hydroquinone monosulfonate, sodium hydroquinone monosulfonate); 3-pyrazolidones (for example, 1-phenyl-3-pyrazolidone, 1-phenyl-4-methyl-3-pyrazolidone, 1-phenyl-4-dimethyl-3-pyrazolidone, 1-phenyl-4-ethyl-3-pyrazolidone, 1-phenyl-5-methyl-3-pyrazolidone, 1-phenyl-4-methyl-4-hydroxymethyl-3-pyrazolidone, 1-phenyl-4,4-dihydroxymethyl-3-pyrazolidone); aminophenols (for example, o-aminophemol, p-aminophenol, N-methyl-o-aminophenol, N-methyl-p-aminophenol, 2,4-diaminophenol); 1-aryl-3-aminopyrazolines (for example, 1-(p-hydroxyphenyl)-3-aminopyrazoline, 1-(p-amino-m-methylphenyl)-3-aminopyrazolines; and mixtures thereof.

Preferred examples of the color developing agent are primary aromatic amine dedeloping agents such as phenylenediamines (for example, 4-amino-N,N-diethylaniline, 3-methyl-4-amino-N,N-diethylaniline, 4-amino-N-ethyl-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidethylaniline, 4-amino-3-methyl-N-ethyl N-$\beta$-methoxyergtlaniline).

There may also be used other developing agents described in "Photographic Processing Chemistry" by L. F. A. Mason, Focal Press (1966), pp.226–229, and Japanese Patent O.P.I. Publication No. 64833/1973.

These developing agents are preferably used at an concentration of about 0.1 to 80 g/l, and more preferably 0.2 to 50 g/l.

When necessary, the developer may contain preservatives (for example, sulfites, bisulfites), buffers (for example, carbonates, boric acid, borates, alkanolamines), alkali agents (for example, hydroxides, carbonates), dissolving aids (for example, polyethylene glycols, esters thereof), pH conditioners (for example, organic acids such as acetic acid), sensitizers (for example, quaternary ammonium salts), developing accelerators and hardeners (for example, dialdehydes such as glutaraldehyde) and surfactants. Further, there may also be contained in the developer antifiggants (for example, halides such as potassium bromide, sodium bromide, and benzotriazole, benzothiazole, tetrazolethiazole), chelating agents (for example, ethyllenediamine tetracetic acid, alkali metal salts thereof, polyphosphates, nitrilotriacetates).

As for fixers, the following are preferred.

The fixer preferably contains a thiosulfate. Such a thiosulfate is supplied as solid; to be more precise, it is supplied as a lithium, potassium, sodium or ammonium salt and dissolved before use. Preferably, it is supplied as a sodium or ammonium salt and dissolved before use. Especially, it is supplied as an ammonium salt and dissolved before use, and thereby a fixer with a high fixing speed is obtained. The thiosulfate concentration is generally 0.1 to 5 mols/l, preferable 0.5 to 2 mols /l, and especially 0.7 to 1.8 mols/l.

The fixer contains a sulfite. The concentration of sulfite is not more than 0.2 mol/l, and preferably not more than 0.1 mol/l, in a mixed aqueous solution of thiosulfate and sulfite. As sulfite, a solid salt of lithium, potassium, sodium or ammonium is supplied and used by being dissolved together with the above solid thiosulfate.

The fixer preferably contains citric acid, tartaric acid, malic acid or succinic acid; and as phenylacetic acid, citric acid, iso-citric acid, malic acid, tartaric acid, succininc acid, or optical isomers of these acids.

Preferred salts of these acids are salts of lithium, potassium, sodium and ammonium, such as potassium citrate, lithium citrate, sodium citrate, ammonium citrate, lithium hydrogentartarate, potassium hydrogentartarate, potassium tartarate, sodium hydrogentartarate, sodium tartarate, ammonium hydrogentartarate, ammonium potassium tartaraste, sodium potassium tartarate, sodium malate, ammonium malate, sodium succinate and ammonium succinate. These salts may be used singly or in combination Among the above compounds, citric acid, iso-citric acid, malic acid, phenylacetic acid and salts thereof are particularly preferred.

These citric acid, tartaric acid, malic acid succinic acid, are supplied in solid and dissolved in a water-based solvent before use, and their content in a fixer is preferably more than 0.05 mol/l and especially 0.2 to 0.6 mol/l.

Besides the above compounds, the fixer may contain various additives such as acids, salts, chelating agents, surfactants, wetting agents and fixing accelerators.

Examples of the acid include inorganic acids such as sulfuric acid, hydrochloric acid, nitric acid, boric acid; and organic acids such as formic acid, propionic acid, oxalic acid, malic acid.

Examples of such a chelating agent are aminopolycarboxylic acids such as nitrilotriacetic acid and ethylenediamine tetracetic acid; and salts thereof.

As a surfactant, there may be used, for example, anionic surfactants such as sulfates and sulfonates; nonionic surfactants such as polyethylene glycol type and ester type; and amphoteric surfactants such as those described in Japanese Patent O.P.I. Publication No. 6840/1982 (Title of the invention: Photographic fixers).

Examples of the wetting agents include alkanolamines and alkaline glycols.

The fixing accelerator includes, for example, thiourea derivatives described in Japanese Patent Examined Publication Nos. 35754/1970, 122535/1983, 122536/1983; alcohols having a triple bond in the molecular; and thioethers described in U.S. Pat. No. 4,126,459.

Among the above additives, acids, such as sulfuric acid, boric acid, aminopolycarboxylic acid, and their salts are preferred. The addition amount of these additives is preferably 0.5 to 20 g/l.

Solidification or molding of processing agents for developer and fixer, which are normally in a powder state, can be carried out by the direct powder compression method, dry granule compression method or wet granule compression method, or a method to coat the surface of a solid processing agent prepared by the above methods with a water-soluble polymer to form films, method to add a water-soluble polymer to a powder processing agent and then pour the mixture into a mold to dry it to solid, or method to coat the surface of the powder and then compress the powder into solid. Further, in order to solidify processing agents which are normally in a liquid state, there may be used a method to add a water-soluble polymer to such liquid processing agents and pour the mixture into a mold to dry it to solid.

The preferred in the invention are the direct compression molding, a method to subject a granular processing agent to surface coating with a water-soluble polymer and then to compression molding, capsulation, and a method comprising steps of dissolving a powder processing agent in a volatile solvent and evaporating the solvent in a container to obtain a solid agent.

The water-soluble polymer mentioned here includes synthetic, semisynthetic and natural water-soluble polymers such as gelatin, pectin, polyacrylic acid, polyacrylates, polyvinyl alcohol, polyvinylpyrrolidone, vinylpyrrolidone-vinylacetate copolymer, polyethyleneoxide, sodium carboxymethyl cellulose, hydroxypropyl cellulose, methyl cellulose, ethyl cellulose, alginates, xanthane gum, gum arabic, tragacanth gum, calaya gum, carrageenan and methyl vinylether-maleic anhydride copolymer. These may be used singly or in combination. In the invention, polyvinylpyrrolidone, hydroxypropyl cellulose, methyl cellulose, gum arabic and carrageenan are preferably used singly or in combination.

The shape of the mold into which a processing agent is poured is not particularly limited. Although rectangular, cylindrical or other shapes of molds may be arbitrarily used, rectangular molds, particularly tabular molds are preferred in view of a high drying capability and capability of providing a processing agent having a high solubility in preparing a solution.

Figure 2:
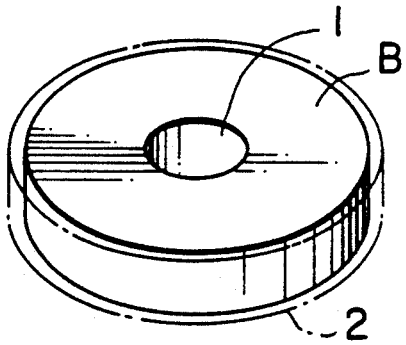

FIG. 1 shows photographic processing agent A solidified by the direct compression molding, which has a tabular shape and plural openings 1. FIG. 2 is a photographic pressing agent B molded likewise into a disk, which has opening 1 at the center.

Solidification of a photographic processing agent into blocks as illustrated improves the adaptability of the processing agent to the automatic solution-preparing-and-feeding system for replenishment processing agents (replenishing solution) built in automatic developing machines. That is, in conventional automatic developing machines, manual operations are required to throw a replenishing solution supplied as a high-concentration solution into a replenishing solution tank, and to dilute it to a prescribed concentration with the addition of a fixed amount of water; however, use of a photographic processing agent solidified into blocks (for powder and granular agents, one container is regarded as one block) allows the processing agent to be stored in bulk and, for example, to be automatically thrown by a fixed number of blocks (or to be released from the container, in case of powder and granular agents) at a time into a replenishing solution tank, according to the liquid volume information detected by a liquid level sensor arranged inside of the replenishing solution tank, and water is simultaneously replenished by opening a valve and stirring is carried out, and thus a replenishing processing solution is automatically prepared.

Figure 4:
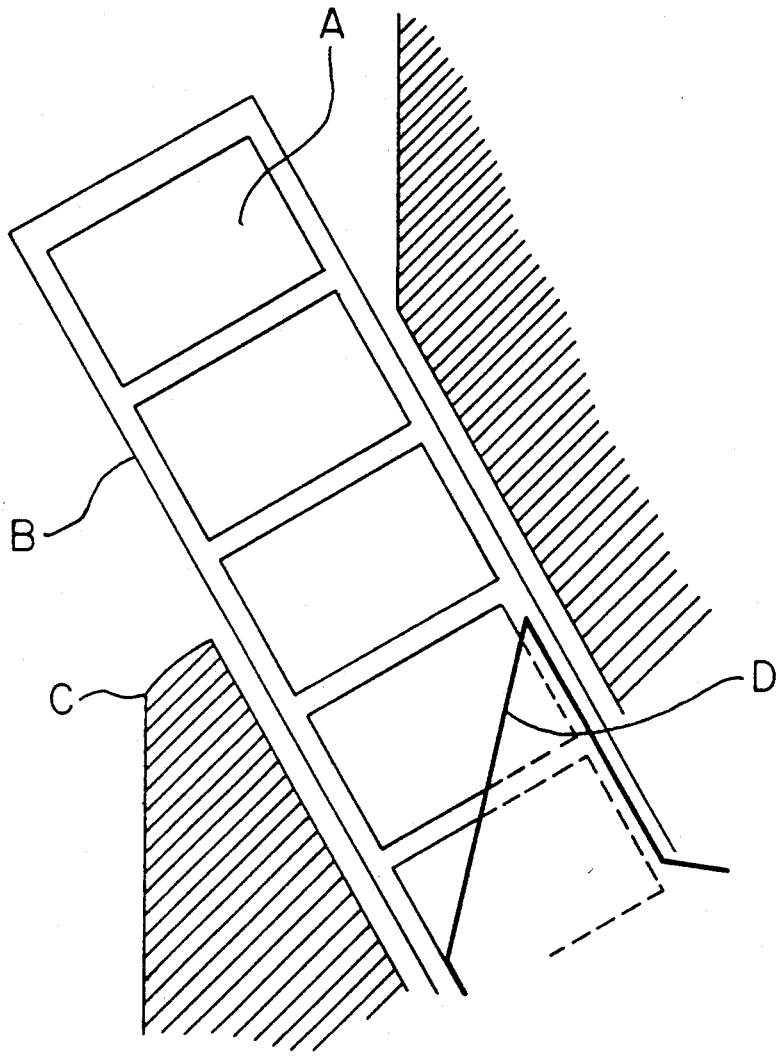
FIG. 4 illustrates that the solidified photographic processing agent A packaged by cardboad box B is pushed into the charging prening of the automatic solution preparing unit and cutter D tears off a part of the box.
Figure 5:
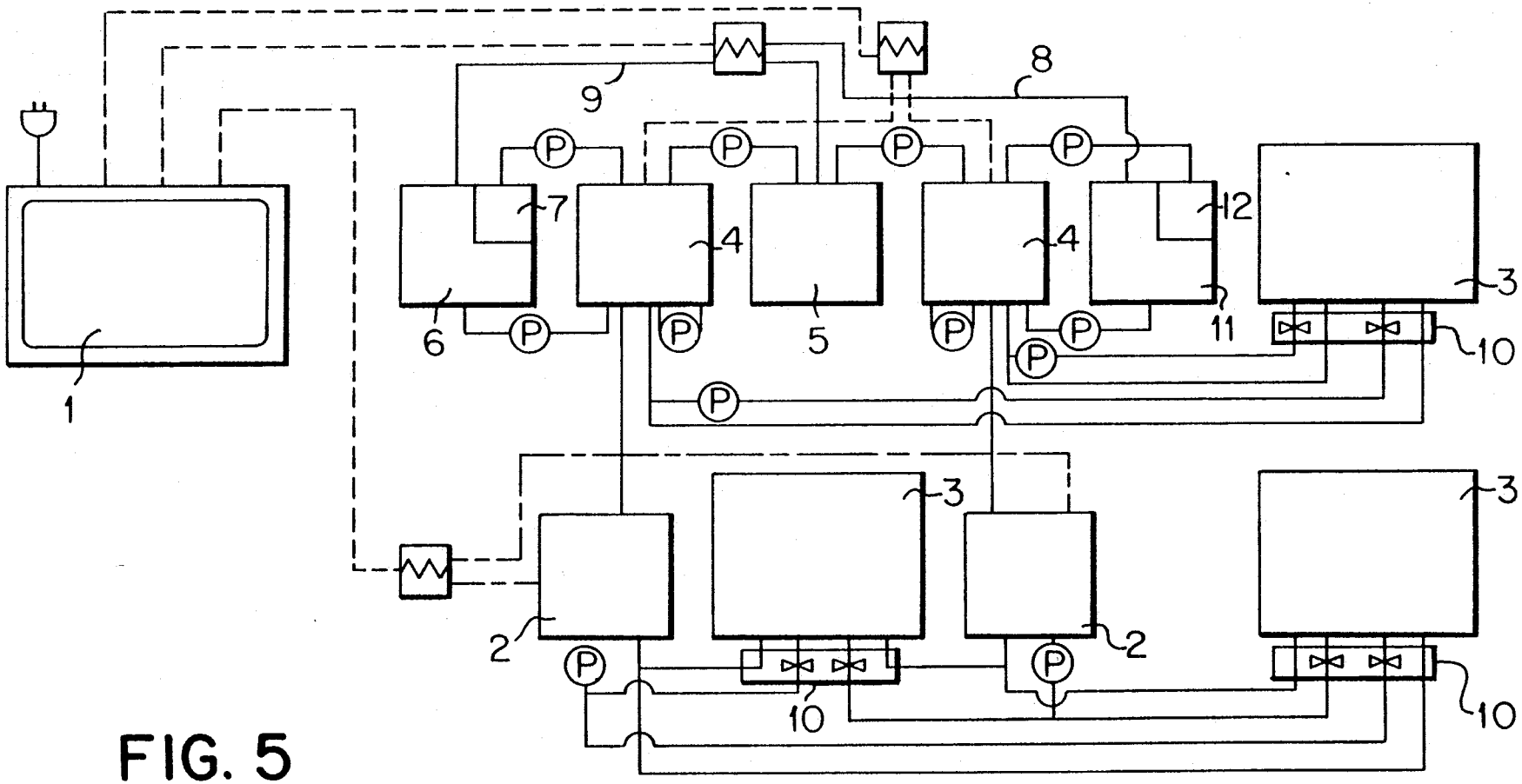
FIG. 5 illustrates an automatic photographic material processor.

In FIG. 4, the solid photographic processing agent in block form A, packed in a cardboard box B of this invention, is put into the charging opening C, and is pushed down so that a cutter D tear off the cardboard box and the blocks supplied to the automatic solution preparing unit. The cardboard box is strong enough to keep the original shape when the pushing force from the out side is applied during the cutter D tearring off the packaging material.

The stirring is carried out, for example, by rotating a stirring rod standing uprightly from the bottom of the tank, or by jets made with rotating blades like ones used in an electric washing machine or with a circulating pump. But in either case, a photographic processing agent solidified, for example, to a size of 20 cm×10 cm×10 cm (with no openings) takes a time to dissolve, and the replenishing solution cannot be fed during such a dissolving time.

However, when a block of solid processing agent A is thrown into a tank to prepare a replenishing solution, it dissolves in a very short time, because it rotates to the rotation of a stirring rod with opening 1 clinging to the stirring rod. Further, if an inverted V-shaped stirring rod is uprightly installed on the bottom of the tank, a thrown processing agent block is immediately caught by the stirring rod and begin to rotate. Or if a block of processing agent A is thrown into a tank, in which four short stirring rods erected from the bottom simultaneously rotate in the same direction, the block dissolves rapidly while rotating with opening 1 clinging to the stirring rods.

As apparent from the above description, the shape of block itself as well as the shape, number and position of opening 1 in a block-shaped photographic solid processing agent depend upon the structure of the stirring means; therefore, they are not limited to particular ones.

EXAMPLE

There was carried out an experiment to dissolve photographic solid processing agents A and B of the following compositions with jet streams generated by pump using no stirring rod. At the same time, a comparative experiment was made on photographic solid processing agents C and D (not illustrated), which were in the form of blocks but not provided with opening 1. The photographic processing agents A to D were prepared to have the same volume and weight.

| | |
|---|---|
| Anhydrous potassium carbonate | 750 g |
| Anhydrous sodium sulfite | 85 g |
| Potassium iodide | 0.04 g |
| Sodium bromide | 26 g |
| Hydroxylamine sulfate | 40 g |
| Sodium 1-hydroxyethylidene-1,1-diphosphonate | 30 g |
| 4-(N-ethyl-N-β-hydroxyethylamino)-2-methylaniline sulfate | 95 g |
| Total | 1,026.04 g |

In the experiments, each photographic processing agent was thrown into a tank filled with water of 20° C., and a time till the agent dissolved completely was measured. The results are shown in Table 1.

TABLE 1

| Processing agent | Dissolving time |
|---|---|
| A | 20 sec |
| B | 17 sec |
| C | 35 sec |
| D | 35 sec |

It is understood from Table 1 that photographic processing agents A and B were readily soluble even when no stirring rod was used, because opening 1 facilitated the dissolution by liquid jets.

Figure 3:
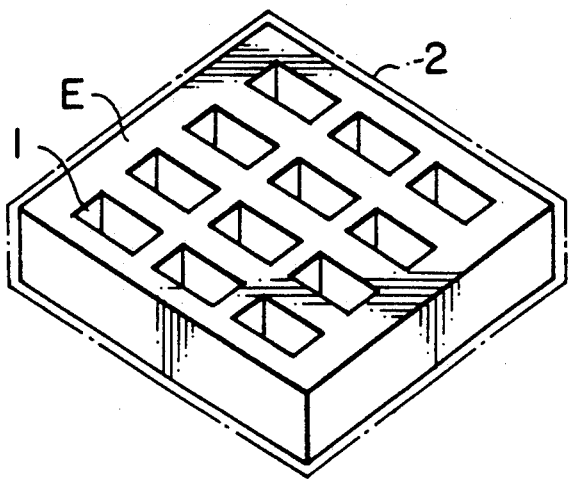

Further, another experiment was carried out on photographic solid processing agents E and F, which were prepared by adding a water-soluble polymer to a composition constituting a photographic processing agent and then drying the mixture to solid in different molds. Photographic processing agent E was provided with openings 1 in a gridiron pattern as illustrated in FIG. 3, and photographic processing agent F (not illustrated) had no opening 1 at all. The experiment was made in the same manner as that shown in Table 1. The results are shown in Table 2.

TABLE 2

| Processing agent | Dissolving time |
|---|---|
| E | 10 sec |
| F | 39 sec |

Next, a similar dissolving experiment was carried out on photographic processing agents G, H, I and J, which were obtained by spraying or coating on the surface of processing agents A, B, C and D prepared by the direct compression molding with a water-soluble polymer (hydroxypropyl cellulose). The results are shown in Table 3.

TABLE 3

| Processing agent | Dissolving time |
|---|---|
| G | 22 sec |
| H | 19 sec |
| I | 38 sec |
| J | 38 sec |

It is confirmed through the above experiments that solidifying a photographic processing agent brings a decisive advantage in transport because of lightness and non-bulkiness, and that a photographic solid processing agent has a good adaptability to an automatic preparation unit for replenishing solution built in an automatic developing machine. However, a photographic processing agent in the form of powder or granules, or that solidified by the direct compression molding, requires to be packed because chemicals for development are liable to be oxidized. Therefore, the present invention uses, as a packing material for such a processing agent, cardboard cases whose outer surface or inner surface or both of them are coated with a synthetic resin to exclude the outside air, so that the inside processing agent is protected from aging deterioration.

The shape of said cardboard case is generally rectangular, but a cylindrical one can be also used; accordingly, the shape is not particularly limited.

As synthetic resin films to exclude the outside air, there may be used films of macromolecular compounds such as polyethylene, polyethylene terephthalate and polychloroethylene.

In the invention, use of a flexible synthetic resin film having an oxygen permeability of 20 ml/m$^2$/24 Hr or less is particularly preferred.

The flexible synthetic resin film having an oxygen permeability of 20 ml/m$^2$/24 Hr or less used in the invention may be a single resin film, or a laminated resin film consisting of two or more layers.

Examples of the single-layered synthetic resin film which meets the above condition include (1) polyethylene terephthalate (PET) having a thickness of 0.1 mm or more, (2) acrylonitrile-butadiene copolymer having a thickness of 0.3 mm or more, and (3) rubber hydrochloride having a thickness of 0.1 mm or more. Among them, polyethylene terephthalate is preferred for its high resistance against alkali and acid.

Examples of the laminated synthetic resin film which meets the above condition include (4) PET/polyvinyl alcohol-ethylene copolymer (EVAL)/polyethylene (PE), (5) oriented polypropylene (OPP)/EVAL/PE, (6) unoriented polypropylene (CPP)/EVAL/PE, (7) nylon (N)/aluminum foil (Al)/PE, (8) PET/Al/PE, (9) cellophane/PE/Al/PE, (10) Al/paper/PE, (11) PET/-PE/Al/PE, (12) N/PE/Al/PE, (13) paper/PE/Al/PE, (14) PET/Al/PET/polypropylene (PP), (15) PET-/Al/PET/high density polyethylene (HDPE), (16) PET/Al/PE/low density polyethylene (LDPE), (17) EVAL/PP, (18) PET/Al/PP, (19) paper/Al/PE, (20) PE/PVCD-coated nylon/PE/ethylvinyl acetate-polyethylene condensate (EVA), (21) PE/PVDC-coated N/PE, (22) EVA/PE/Al-deposited nylon/-PE/EVA, (23) Al-deposited nylon/N/PE/EVA, (24) OPP/PVDC-coated N/PE, (25 PE/PVDC-coated N/PE, (26) OPP/EVAL/LDPE, (27) OPP-/EVAL/CPP, (28) PET/EVAL/LDPE, (29) ON (oriented nylon)/EVAL/LDPE and (30) (unoriented nylon)/EVAL/LDPE. Of them, those denoted by (20) to (30) are preferably used.

The appropriate thickness of these films, though varying depending upon film types, is 0.5 μm to 500 μm, and preferably 1 μm to 200 μm.

In embodying the invention, when film is formed on the surface of a photographic solid processing agent in order to prevent oxidation by spray coating of a water-soluble polymer or by other means, the processing agent can be improved synergistically in the storage stability such as moisture resistance by being packed with the packing material of the invention.

The processing agent solidified with a water-soluble polymer is kept packed in a packing material of the invention till it is set in an automatic solution preparating unit of automatic developing machine. Such a solidified processing agent has advantages that it does not lose the moisture resistance for a fairly long time even while standing ready for use after being unpacked and set in the automatic solution preparating unit of automatic developing machine, and that when provided with suitable opening 1, it can be rapidly dissolved by only generating a circulation flow with a pump, not by rotating it with a stirring rod.

EXAMPLE

There were prepared 5 cm×10 cm×20 cm boxes from two 1-mm-thick paper boards respectively covered on the reverse side and on the both sides with an approximately 0.02-mm-thick polyethylene terephthalate film and an uncovered paper board of the same kind. Under conditions of 20° C. and 50% RH, 300 g each of a granular developer was placed and sealed in these three types of boxes {1}, and the above solid processing agents A, E and G were also placed and sealed in these boxes in a like manner (300 g per box) to obtain samples {2}, {3} and {4}. Each sample was derided into two portions, and these portions were then kept for 3 days in environments of 20° C., 50% RH and 20° C., 70% RH, respectively. After that, they were unsealed to evaluate the moisture resistance. The results are shown in Table 4.

TABLE 4

| | (1) Processing agent granule 2 | | (2) Processing agent A | | (3) Processing agent E | | (4) Processing agent G | |
|---|---|---|---|---|---|---|---|---|
| | 20° C., 50% RH | 20° C., 70% RH | 20° C., 50% RH | 20° C., 70% RH | 20° C., 50% RH | 20° C., 70% RH | 20° C., 50% RH | 20° C., 70% RH |
| Only reverse side (inner side) was coated | Δ | X | ○ | Δ | ○ | ○ | ○ | ○ |
| Both sides were coated | Δ | X | ○ | ○ | ○ | ○ | ○ | ○ |
| Coating was not made | XX | XX | Δ | X | ○ | Δ | ○ | Δ |

○: No change
○: Very slight moisture absorption, but no substantial effect
Δ: Slight moisture absorption, slight hindrance in handling
X: Moistened, sticky surface, care must be taken in handling
XX: Heavily moistened, sticky surface, difficult to handle All the above cardboards could be disposed by incineration with little generation of toxic gases.

In embodying the invention, the above processing agent may be divided into two or more portions to solidify each portion separately.

Next, preparation of solid processing agents is described.

EXAMPLE

The powders shown in Table 5 were mixed by stirring and poured into a proper container. Then, 200 g of hydroxypropyl cellulose was added thereto and stirred well. After being thoroughly mixed, the content was poured into a rectangular mold with a 20 cm length, 10 cm width and 10 cm depth and dried.

TABLE 5

| | |
|---|---|
| Anhydrous potassium carbonate | 750 g |
| Anhydrous sodium sulfite | 85 g |
| Potassium iodide | 0.04 g |
| Sodium bromide | 26 g |
| Hydroxylamine sulfate | 40 g |
| 1-Hydroxyethylidene-1,1-diphosphonic acid | 30 g |
| 4-(N-ethyl-N-β-hydroxyethylamino)-2-2 methylaniline sulfate | 30 g |
| Total | 961.04 g |

EXAMPLE

The powders shown in Table 5 and 200 g of polyvinylpyrrolidone were thrown into the container used in Preparation 1 and mixed therein. Then, the mixture was dried in the container.

The solidified processing agent prepared as above was stable, in spite of being a mixture of reactive compounds, and readily soluble in water when made into a solution.

The solidified photographic processing agent according to the invention has advantages that it is stable and low in aging deterioration in spite of being a mixture of compounds reactive with one another, since more than one of its components is solidified with a water-soluble polymer, that it is more convenient than conventional liquid processing agents in transport and supply because of its lightness and non-bulkiness, and that it is improved in protective measures for chemical properties such as moisture resistance and in water-solubility without impairing the adaptability to the automatic solution preparing unit of an automatic developing machine.

What is claimed is:

1. A solid photographic processing agent for use in an automatic processing apparatus, comprising:

a powdered or granular photographic processing agent, a water-soluble polymer, and a disposable packaging; wherein said powdered or granular photographic processing agent being molded into a block, and thereafter being packaged with said disposable packaging.

2. The solid photographic processing agent of claim 1, wherein said block is formed with an opening.

3. The solid photographic processing agent of claim 1, wherein said block is mixed with water-soluble polymer before packaging.

4. The solid photographic processing agent of claim 1, wherein said block is coated with water-soluble polymer before packaging.

5. The solid photographic agent of claim 2, wherein the opening fits onto a stirring unit.

6. The solid photographic processing agent of claim 1, wherein the packaging material is coated with a plastic film having an oxygen permeability of less than 20 $ml/m^2/24$ Hr.

7. The solid photographic processing agent of claim 1, wherein a package formed with the packaging material has an enough strength of keeping its form during being pushed into an automatic solution preparing unit and teared off by a cutter equipped with the automatic solution preparing unit.

8. The solid photographic processing agent of claim 1, wherein the disposable packaging is of cardboard.

9. A method of making a solid photographic processing agent comprising the steps of:

mixing a powdered or granular processing agent with a water-soluble polymer, solidifying them into a block in a mold.

packaging the block with a packaging material which is coated with a plastic film having an oxygen permeability of less than 20 $ml/m^2/24$ Hr wherein a package formed with the packaging material has an enough strength of keeping its form during being pushed into an automatic solution preparing unit and teared off by a cutter equipped with the automatic solution preparing unit.

10. A method of making a solid photographic processing agent comprising the steps of:

mixing a powdered or granular processing agent, pressing it into a block with a die, coating the block with a water-soluble polymer packaging the coated block with a packaging material which is coated with a plastic film having an oxygen permeability of less than 20 $ml/m^2/24$ Hr wherein a package formed with the packaging material has an enough strength of keeping its form during being pushed into an automatic solution preparing unit and teared off by a cutter equipped with the automatic solution preparing unit.

* * * * *